US009263205B2

(12) United States Patent
Blondel

(10) Patent No.: US 9,263,205 B2
(45) Date of Patent: Feb. 16, 2016

(54) ELECTRIC SWITCHING APPARATUS

(71) Applicant: Schneider Electric Industries SAS, Rueil Malmaison (FR)

(72) Inventor: Charles Blondel, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/087,339

(22) Filed: Nov. 22, 2013

(65) Prior Publication Data

US 2014/0167891 A1 Jun. 19, 2014

(30) Foreign Application Priority Data

Dec. 14, 2012 (FR) ..... 12 62033

(51) Int. Cl.

| | |
|---|---|
| ***H01H 9/00*** | (2006.01) |
| ***H01H 9/20*** | (2006.01) |
| ***H01H 50/54*** | (2006.01) |
| ***H01H 71/46*** | (2006.01) |

(52) U.S. Cl.

CPC ..... *H01H 9/20* (2013.01); *H01H 50/541* (2013.01); *H01H 71/462* (2013.01)

(58) Field of Classification Search

CPC ..... H01H 9/20; H01H 71/462; H01H 71/02; H01H 71/177; H01H 71/179; H01H 71/202

USPC ..... 335/2, 177, 179, 202, 78, 128

See application file for complete search history.

(56) References Cited

U.S. PATENT DOCUMENTS 4,345,225 A * 8/1982 Lemmer ..... H01H 50/02 335/132

5,197,594 A * 3/1993 Drexler ..... H01H 50/021 200/307

(Continued)

FOREIGN PATENT DOCUMENTS

DE 35 03 292 A1 8/1986

EP 0 779 640 A2 6/1997

(Continued)

OTHER PUBLICATIONS

French Preliminary Search Report issued in Aug. 27, 2013 French Application 12 62033, filed on Dec. 14, 2012 (with English Translation of Categories of Cited Documents).

*Primary Examiner* — Bernard Rojas

(74) *Attorney, Agent, or Firm* — Oblon, McClelland, Maier & Neustadt, L.L.P.

(57) ABSTRACT

The invention relates to an electric switching apparatus (1) comprising:

a switching unit (10) having:

an electromagnetic actuator (12) to command opening and/or closing of electric contacts (11), mechanical latching means (15) designed for connection of a detachable add-on unit (20), said latching means, in a first operating position, enabling fixing of said add-on unit on said switching unit, The switching apparatus comprises electric power supply means designed to supply power to the electromagnetic actuator (12) and being arranged to operate in a manner that is dependent on the position of the latching means (15). The electric power supply means are inoperational when the latching means are not in the first operating position, the actuating coil (17) of the electromagnetic actuator (12) not being able to be supplied.

17 Claims, 5 Drawing Sheets

(56) References Cited

U.S. PATENT DOCUMENTS 5,652,420 A * 7/1997 Innes ..... H01H 83/22
200/307
8,378,767 B2 * 2/2013 Okubo ..... H01H 50/323
335/128

FOREIGN PATENT DOCUMENTS

EP 0 951 043 A1 10/1999
FR 2 777 693 10/1999

* cited by examiner

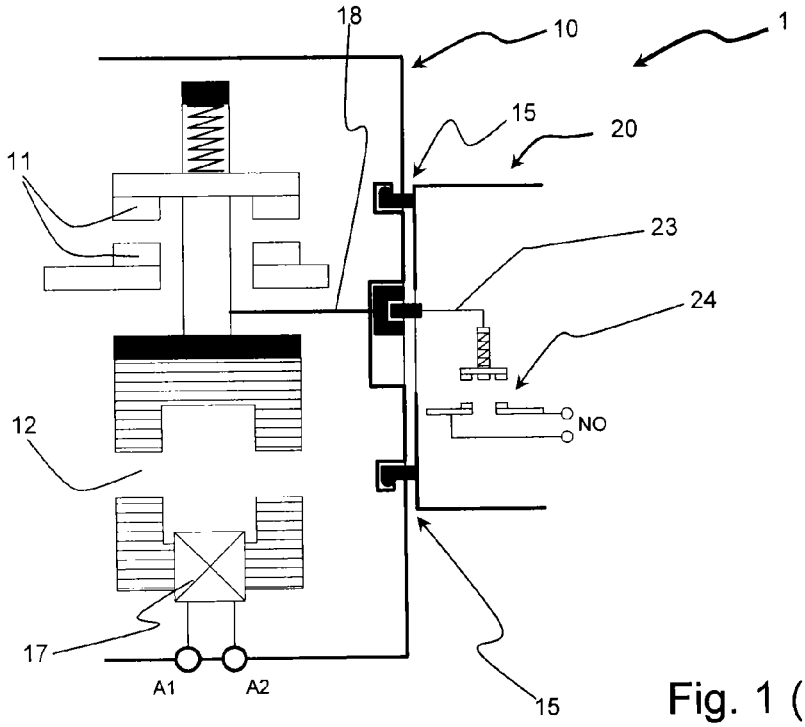
Fig. 1 (state of the art)
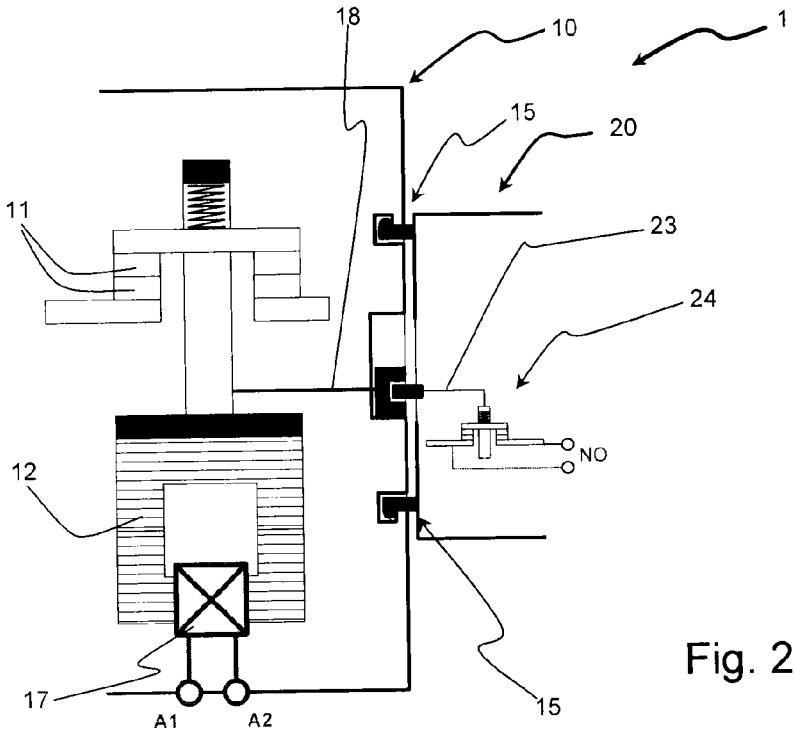
Fig. 2 (state of the art)

ELECTRIC SWITCHING APPARATUS

BACKGROUND OF THE INVENTION

The invention relates to an electric switching apparatus comprising a switching unit having electric contacts commanded to opening and/or closing. An electro-magnetic actuator commands opening and/or closing of the electric contacts. The switching apparatus also comprises mechanical latching means designed for connection of a detachable add-on unit, said latching means, in a first operating position, enabling mechanical fixing of the detachable add-on unit on the switching unit.

The invention also relates to a detachable add-on unit designed to be connected to an electric switching apparatus according to the invention.

STATE OF THE ART

In an electric installation, different components are used. In order to ensure efficient automation (control, operation checking, etc.), the installed products provide status information. In numerous cases, it is proposed to the user to be able to add optional modules to the products in order to have additional information available. During installation or during maintenance phases, human errors can consequently occur. Indeed, as represented in FIGS. 1 and 2, these optional modules are generally "clip-fastened" to the main products, and no error prevention means are provided to prevent incorrect installation. This can prove dangerous when the optional module is designed to check for example an opening fault on a contactor (e.g. welding of the contacts) or to indicate power supply of a machine.

Certain patents (FR2777693) describe solutions integrating error prevention means for fitting an add-on unit on a circuit breaker. The object of the solution described in the state of the art is to prevent any fitting of the unit on the circuit breaker if the respective positions of the two elements (circuit breaker and add-on unit) are not identical. This type of solution does not always guarantee correct operation over time. Indeed, if fitting of the unit is performed at the time when fitting of the add-on unit is performed, nothing prevents the add-on unit from "coming adrift" in the course of operation, this loss of securing being for example due to a shock or to vibrations.

SUMMARY OF THE INVENTION

The object of the invention is therefore to remedy the shortcomings of the state of the art so as to propose a dependable electric switching apparatus.

The switching apparatus according to the invention comprises electric power supply means designed to supply power to the electromagnetic actuator, said means being arranged to operate in a manner that is dependent on the position of the latching means. The electric power supply means are inoperational when the latching means are not in the first operating position, the actuating coil of the electromagnetic actuator not being able to be supplied. The electric power supply means are operational to supply an actuating coil of said electromagnetic actuator when the latching means are in the first operating position.

According to one embodiment of the invention, the electric power supply means comprise electric switching means able to take a first position called "closed" position when the latching means are in the first operating position, and to take a second position called "open" position when the latching means are not in the first operating position. The electric power supply means are operational to supply the actuating coil of the electromagnetic actuator when the electric switching means are in the first "closed" position.

According to a first particular embodiment, the electric switching means are securedly affixed to the detachable add-on unit.

Preferably, the electric switching means comprise a conducting movable branch securedly affixed to the detachable add-on unit and designed to place said switching means in the "closed" position when the latching means are in the first operating position.

Advantageously, in the "closed" position, the conducting movable branch connects a first conductor connected to the actuating coil of the electromagnetic actuator and a second conductor connected to a power supply terminal of the switching apparatus, the first and second conductors being securedly affixed to the switching unit.

Preferably, the electric switching means comprise at least one control switch securedly affixed to the detachable add-on unit and commanded to closing to place said switching means in the "closed" position when the latching means are in the first operating position.

Advantageously, the control switch is connected in series with first and second conducting branches securedly affixed to the detachable add-on unit.

Advantageously, the first conducting branch of the detachable add-on unit is connected to a first electric terminal of said unit designed to be connected to a power supply unit and the second conducting branch is connected to a second electric terminal designed to be connected to a power supply terminal of the electromagnetic actuator, the control switch being positioned between the first and second electric terminals.

According to a first particular embodiment, the electric switching means are securedly affixed to the switching unit.

Preferably, the electric switching means comprise at least one switch securedly affixed to the switching unit and designed to be commanded to closing to place said switching means in the "closed" position when the latching means are in the first operating position.

Advantageously, in the "closed" position, said switch connects a first conductor connected to the actuating coil of the electromagnetic actuator and a second conductor connected to a power supply terminal of the switching apparatus, the first and second conductors being securedly affixed to the switching unit.

Advantageously, the switch comprises control means actuated by the detachable add-on unit latched to the switching unit by the mechanical latching means positioned in the first operating position.

Preferably, the switching apparatus comprises means designed to transmit the position of the electromagnetic actuator.

The detachable add-on unit according to the invention comprises a control switch commanded to place the electric switching means in the "closed" position when the latching means are in the first operating position.

According to a mode of development, the control switch is connected in series with a first conducting branch connected to a first electric terminal of said detachable add-on unit, the first electric terminal being designed to be connected to an external power supply module. The switch is also connected with a second conducting branch connected to a second electric terminal of said detachable add-on unit, the second electric terminal being designed to be connected to a power supply terminal of the electromagnetic actuator of the electric switching apparatus.

BRIEF DESCRIPTION OF THE DRAWINGS

Other advantages and features will become more clearly apparent from the following description of a particular embodiment of the invention given for non-restrictive example purposes only and represented in the appended drawings, in which:

FIG. 1 represents a schematic view of a switching apparatus of known type associated, in a first operating position, with an auxiliary unit of known type;

FIG. 2 represents a schematic view of a switching apparatus and an associated auxiliary unit according to FIG. 1 in a second operating position;

DETAILED DESCRIPTION OF AN EMBODIMENT

Figure 3A:
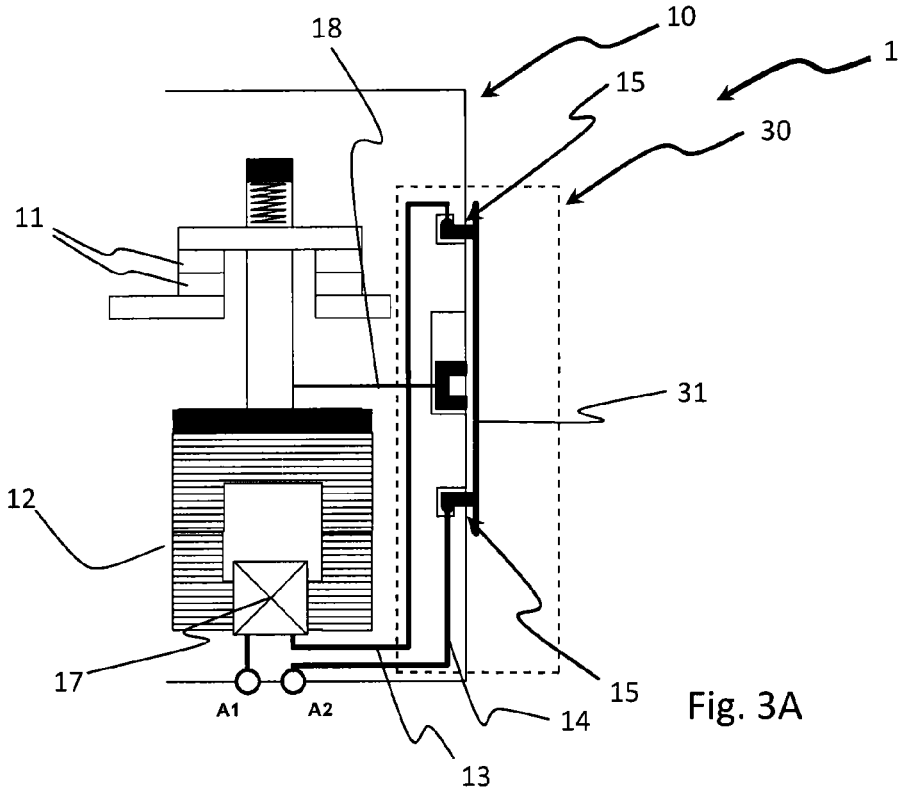
FIG. 3A represents a schematic view of a switching apparatus according to a first preferred embodiment of the invention, in a first operating position.

The electric switching apparatus 1 according to the invention comprises a switching unit 10 comprising electric contacts 11 commanded to opening and/or closing. The unit further comprises an electromagnetic actuator 12 designed to command opening and/or closing of said electric contacts.

As an example embodiment, the electromagnetic actuator comprises a fixed yoke on which an actuating coil 17 is positioned. The electromagnetic actuator 12 also comprises a movable plate that is able to move with respect to the fixed yoke. Movement of the movable plate connected to a movable contact-holder results in movement of the electric contacts 11.

The electric switching apparatus according to the invention comprises mechanical latching means 15. These latching means are designed for connection of a detachable add-on unit 20. Said latching means, in a first operating position, enable mechanical fixing of the detachable add-on unit 20 on the switching unit 10.

According to an embodiment of the invention, the switching apparatus comprises electric power supply means designed to supply the electromagnetic actuator 12.

Said electric power supply means have an operation dependent on the position of the latching means 15. The electric power supply means are in fact operational to supply an actuating coil 17 of the electromagnetic actuator 12 when the latching means 15 are in the first operating position. In other words, the electric power supply means can only be operational to supply the actuating coil 17 if the latching means are in the first operating position.

Inversely, the electric power supply means are inoperational when the latching means are not in the first operating position. In other words, the electric power supply means are not operational to supply the actuating coil 17 if the latching means 15 are not in the first operating position.

As an example embodiment, the electric power supply means comprise an electric supply circuit which is open when the latching means are not in the first operating position. Inversely, the electric supply circuit is closed when the latching means 15 are in the first operating position. The electric supply circuit connected to an external power supply unit (power +) is then able to supply the actuating coil 17.

As an example embodiment, the latching means 15 preferably comprise at least one system called tenon and mortar system where a male part collaborates with a female part. When the male part collaborates with the female part, the latching means are then in the first operating position.

The electric power supply means of the electric switching apparatus according to the invention comprise electric switching means 30 able to take two extreme operating positions.

The switching means 30 can take a first position called "closed" position when the latching means 15 are in the first operating position. Said means can also take a second position called "open" position when the latching means 15 are not in the first operating position.

The electric power supply means are operational to supply the actuating coil 17 of the electromagnetic actuator 12 when the electric switching means 30 are in the first position called "closed" position.

According to certain embodiments of the invention, the electric switching means 30 are securedly affixed to the detachable add-on unit 20. According to other embodiments of the invention, the electric switching means 30 are securedly affixed to the switching unit 10.

Figure 3B:
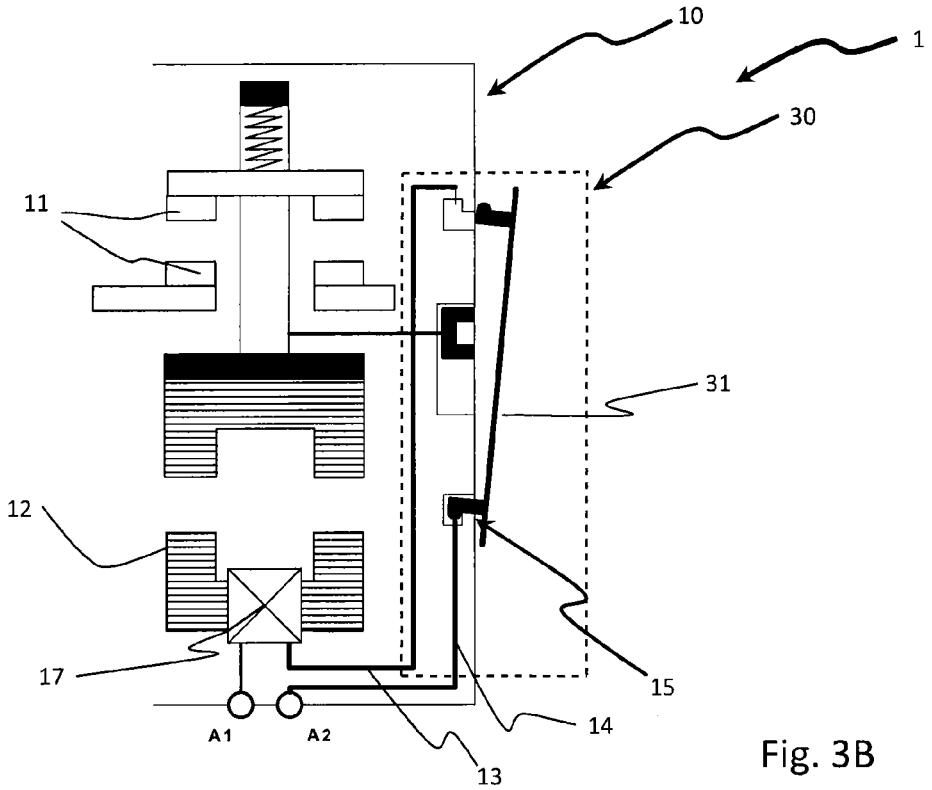
FIG. 3B represents a schematic view of a switching apparatus according to FIG. 3A, in a second operating position.
Figure 4A:
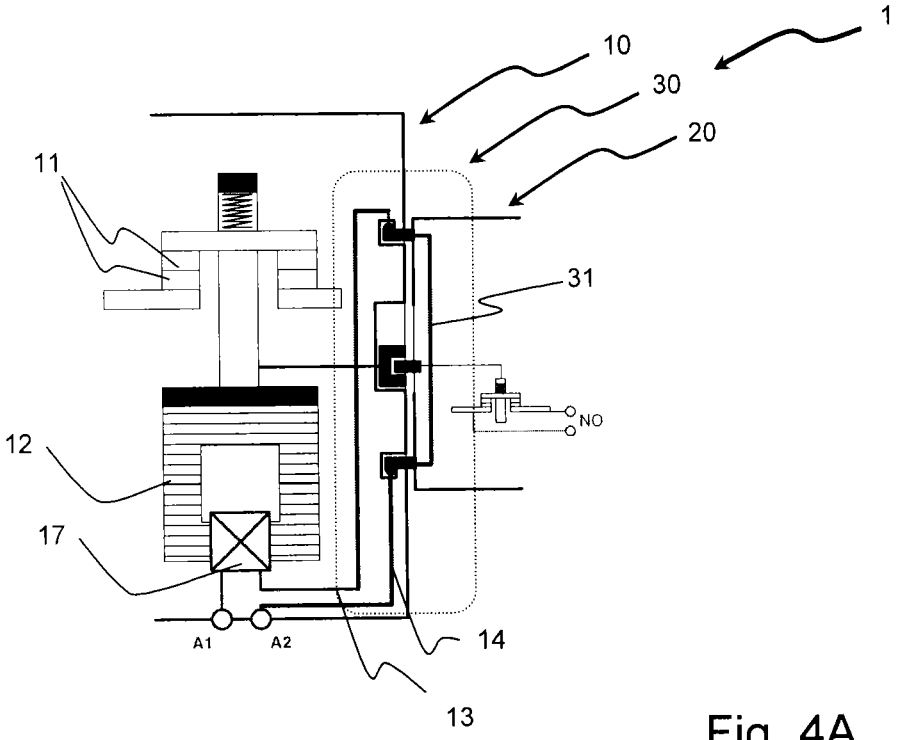
FIG. 4A represents a schematic view of an alternative embodiment of a switching apparatus according to FIG. 3, in a first operating position.
Figure 4B:
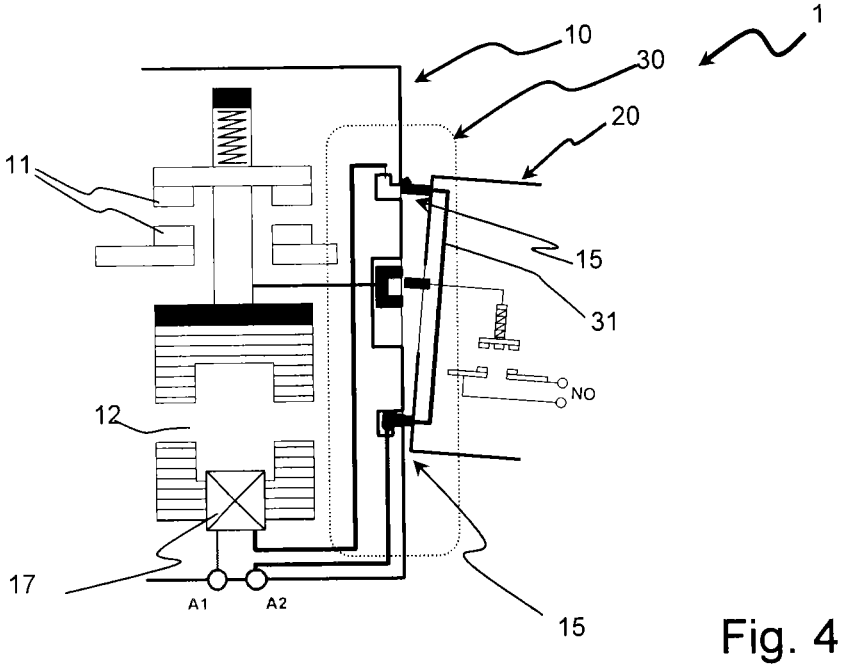
FIG. 4B represents a schematic view of a switching apparatus according to FIG. 4A, in a second operating position.

According to a preferred embodiment of the invention as represented in FIGS. 3A 3B, 4A and 4B, the electric switching means 30 comprise a movable conducting branch 31 securedly affixed to the detachable add-on unit 20. The movable branch is designed to place the electric switching means 30 in the "closed" position when the latching means 15 are in the first operating position (FIGS. 3A and 4A). When the electric switching means 30 are in the "open" position due to the fact that the latching means are not in the first operating position, the electric power supply means are not operational to supply the actuating coil 17 (FIGS. 3B and 4B).

According to this embodiment of the invention, the conducting movable branch 31 in the "closed" position connects a first conductor 13 connected to the actuating coil 17 of the electromagnetic actuator 13 and a second conductor 14 connected to a power supply terminal A2 of the switching apparatus 1. Also according to this embodiment, the first and second conductors are preferably positioned inside the switching unit 10.

Figure 6A:
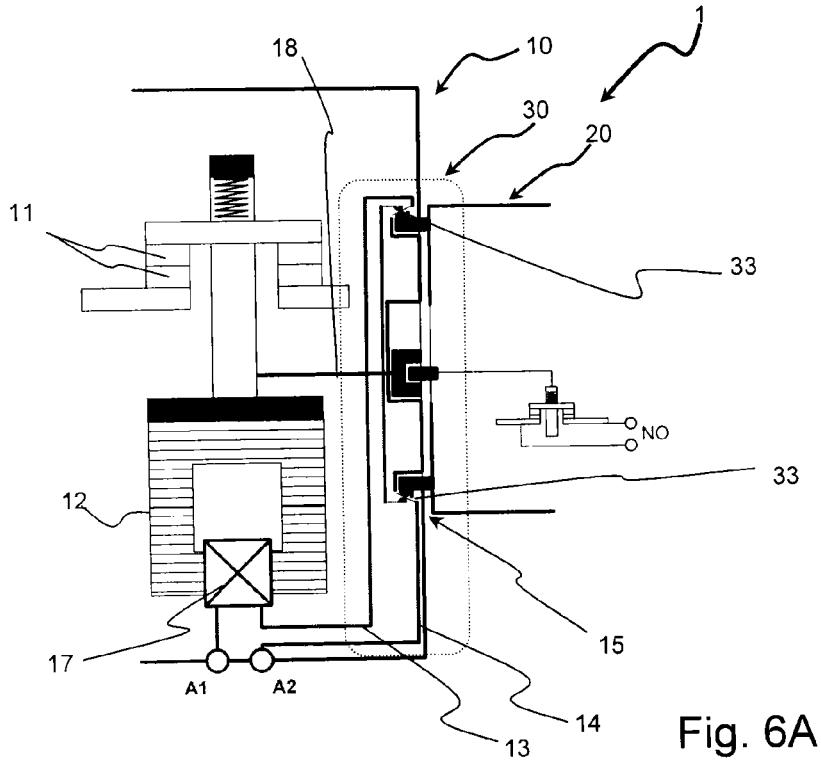
FIG. 6A represents a schematic view of a switching apparatus according to a third preferred embodiment, in a first operating position.
Figure 6B:
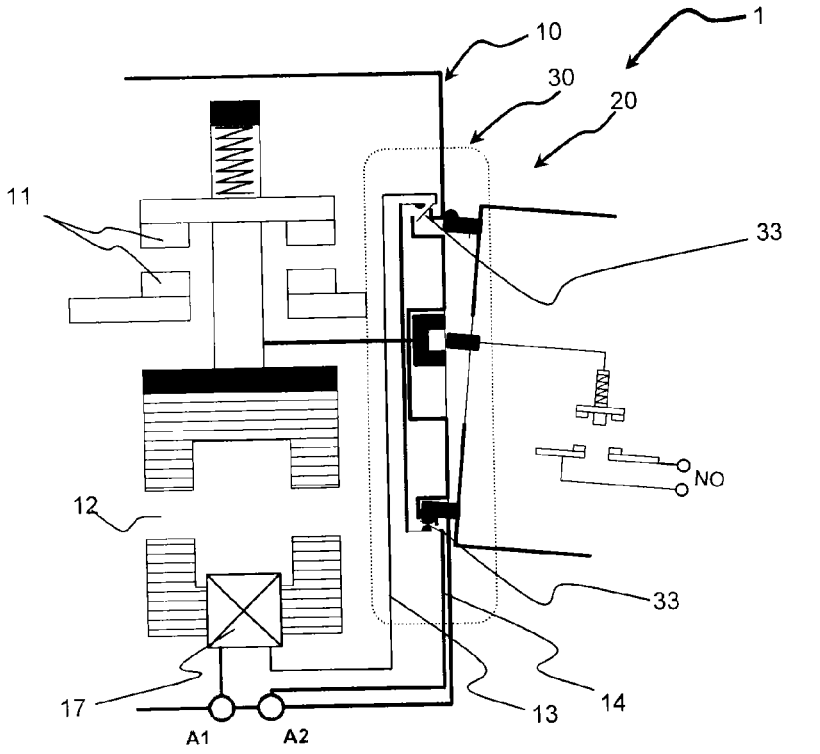
FIG. 6B represents a schematic view of a switching apparatus according to FIG. 6A, in a second operating position.

According to a second preferred embodiment of the invention as represented in FIGS. 6A and 6B, the electric switching means 30 comprise at least one switch 33 commanded to closing when the latching means 15 are in the first operating position. Said switch 33 is designed to place the electric switching means 30 in the "closed" position. As represented, said switch is connected in series with first and second conductors 13, 14 securedly affixed to the switching unit 10. Said switch connects the first conductor 13 connected to the actuating coil 17 of the electro-magnetic actuator 12 and the second conductor 14 connected to a power supply terminal A2 of the switching apparatus 1.

According to this embodiment, the latching means 15 comprise two "tenon and mortar" systems and the electric switching means 30 comprise two switches 33 connected in series. Each "tenon and mortar" system is then associated with a switch 33. Each switch comprises control means actuated by the detachable add-on unit 20 latched to the switching unit 10 by the mechanical latching means 15 positioned in the first operating position.

Figure 5A:
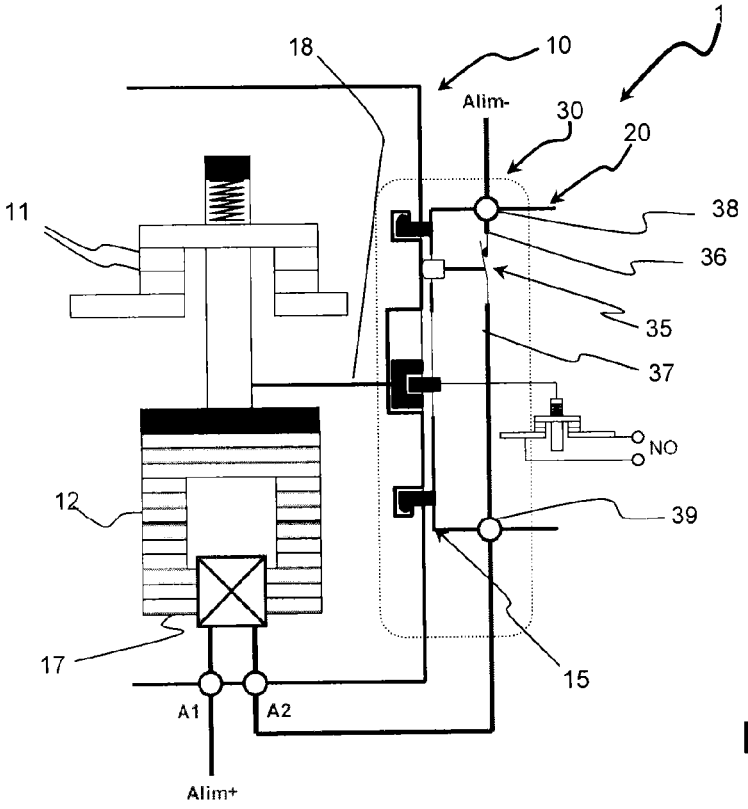
FIG. 5A represents a schematic view of a switching apparatus according to a second preferred embodiment, in a first operating position.
Figure 5B:
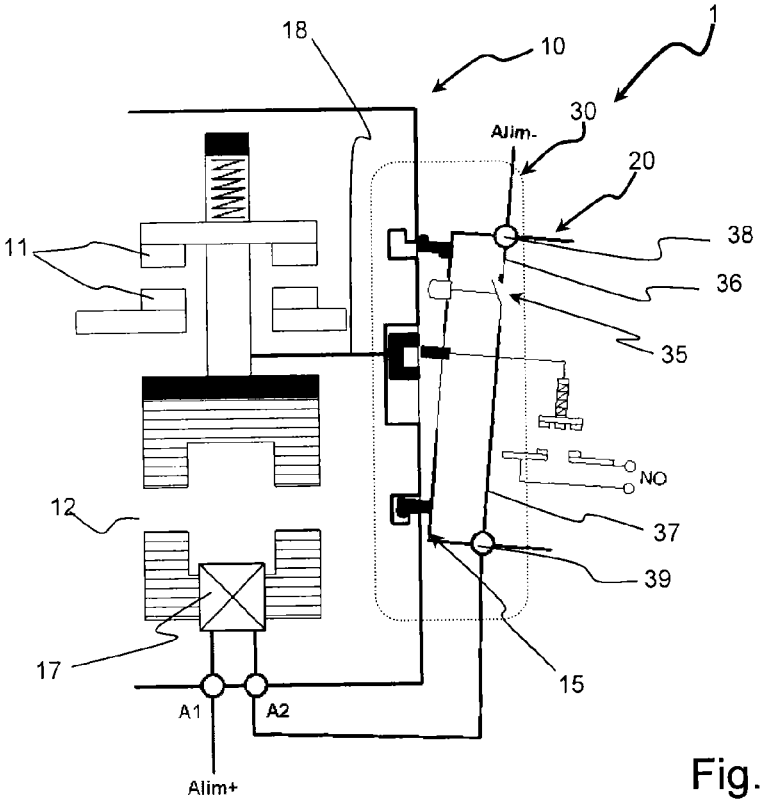
FIG. 5B represents a schematic view of a switching apparatus according to FIG. 5A, in a second operating position.

According to a third preferred embodiment of the invention as represented in FIGS. 5A and 5B, the electric switching means 30 comprise at least one control switch 35 commanded to closing when the latching means 15 are in the first operating position. Said switch designed to place the electric switching means 30 in the "closed" position is connected in series with a first and second conducting branches 36, 37 securedly affixed to the detachable add-on unit 20. The first conducting branch 36 of the detachable add-on unit 20 is connected to a first electric terminal 38 of said unit designed to be connected to a power supply unit. The second conducting branch 37 is further connected to a second electric terminal 39 designed to be connected to a power supply terminal A2 of the electromagnetic actuator 12. The control switch 35 is positioned between the first and second electric terminals 38, 39 of the detachable add-on unit 20.

According to all the embodiments of the invention, the actuating unit 10 comprises means 18 designed to transmit the position of the electromagnetic actuator 12. For example purposes, a mechanical rod system securedly affixed to the movable part of the electromagnetic actuator 12 is able to transmit a movement of said actuator to outside the actuating unit 10. Generally, the detachable add-on unit 20 preferably comprises mechanical control means 23 able to collaborate with the means 18 of the actuating unit 10 when the latching means 15 are in the first operating position. As represented as an example embodiment in FIGS. 1 and 2, the mechanical control means 23 command an electric contact 24 with two positions. The electric state of the electric contact 24 then enables the operating state of the electric switching apparatus 1 to be indicated.

The invention also relates to a detachable add-on unit 20 designed to be connected to an electric switching apparatus 1 as defined in the foregoing. The detachable add-on unit 20 according to the invention comprises a control switch 35 commanded to place the electric switching means 30 in the "closed" position when the latching means 15 are in the first operating position. The electric switching means 30 of the electric switching apparatus 1 in the closed position are then able to make the electric power supply means operational to supply the electromagnetic actuator 12.

Said control switch comprises control means actuated when a surface of the detachable add-on unit 20 comes into contact with a surface of the switching unit 10, the mechanical latching means 15 then positioning themselves in the first operating position.

Said control switch 35 is connected in series with a first conducting branch 36 connected to a first electric terminal 38 of said detachable add-on unit. The first electric terminal 38 is designed to be connected to an external power supply module such as a voltage supply. Said control switch 35 is also connected with a second conducting branch 37 connected to a second electric terminal 39 of said detachable add-on unit. The second electric terminal 39 is designed to be connected to a power supply terminal A2 of the electromagnetic actuator 12 of the electric switching apparatus 1.

The invention claimed is:

1. An electric switching apparatus comprising:

a switch including:

electric contacts that open and close;

an electromagnetic actuator that opens and closes the electric contacts; and a latch that connects a detachable piece, said latch, in a first operating position, enabling mechanical fixing of the detachable piece to the switch;

an electric power supply that supplies power to the electromagnetic actuator, the electric power supply supplies power to an actuating coil of said electromagnetic actuator when the latch is in the first operating position, and the electric power supply does not supply power to the actuating coil of said electromagnetic actuator when the latch is not in the first operating position; and a movable conducting branch, affixed to one of the detachable piece or the switch, that moves the latch into the switch when the latch is in the first operating position, and that moves the latch out of the switch when the latch is not in the first operating position.

2. The electric switching apparatus according to claim 1, wherein the electric power supply includes an electric switch to be in a closed position when the latch is in the first operating position, and to be in an open position when the latch is not in the first operating position, and wherein the electric power supply supplies power to the actuating coil of the electromagnetic actuator when the electric switch is in the closed position.

3. The electric switching apparatus according to claim 2, wherein the electric switch is affixed to the detachable piece.

4. The electric switching apparatus according to claim 3, wherein the electric switch includes the movable conducting branch affixed to the detachable piece, and wherein the electric switch is in the closed position when the latch is in the first operating position.

5. The electric switching apparatus according to claim 4, wherein the movable conducting branch, in the closed position, connects a first conductor to the actuating coil of the electromagnetic actuator, and a second conductor to a power supply terminal of the electric switching apparatus, the first conductor and the second conductor being affixed to the switch.

6. The electric switching apparatus according to claim 3, wherein the electric switch includes at least one control switch affixed to the detachable piece, and wherein the at least one control switch places said electric switch in the closed position when the latch is in the first operating position.

7. The electric switching apparatus according to claim 6, wherein the at least one control switch is connected in series with first and second conducting branches affixed to the detachable piece.

8. The electric switching apparatus according to claim 7, wherein the first conducting branch is connected to a first electric terminal of said detachable piece, the first electric terminal being connected to a power supply, wherein the second conducting branch is connected to a second electric terminal, the second electric terminal being connected to a power supply terminal of the electromagnetic actuator, and wherein the at least one control switch is positioned between the first and second electric terminals.

9. The electric switching apparatus according to claim 2, wherein the electric switch is affixed to the switch.

10. The electric switching apparatus according to claim 9, wherein the electric switch includes at least one switch affixed to the switch, and wherein the at least one switch places said electric switch in the closed position when the latch is in the first operating position.

11. The electric switching apparatus according to claim 10, wherein said at least one switch, in the closed position, connects a first conductor to the actuating coil of the electromagnetic actuator, and a second conductor to a power supply terminal of the electric switching apparatus, the first and second conductors being affixed to the switch.

12. The electric switching apparatus according to claim 10, wherein the at least one switch includes a controller actuated by the detachable piece and latched to the switch by the latch positioned in the first operating position.

13. The electric switching apparatus according to claim 1, further comprising a position transmitter to transmit a position of the electromagnetic actuator.

14. The electric switching apparatus according to claim 2, wherein the detachable piece is connected to the electric switching apparatus, and wherein the electric switch includes a control switch to place the electric switch in the closed position when the latch is in the first operating position.

15. The electric switching apparatus according to claim 14, wherein the control switch is connected in series with a first conducting branch connected to a first electric terminal of said detachable piece, the first electric terminal being connected to an external power supply, and a second conducting branch connected to a second electric terminal of said detachable piece, the second electric terminal being connected to a power supply terminal of the electromagnetic actuator.

16. The electric switching apparatus according to claim 1, further comprising another latch that connects a second conductor to a power supply terminal, wherein the latch connects a first conductor to the actuating coil of the electromagnetic actuator.

17. The electric switching apparatus according to claim 16, wherein the first conductor and the second conductor are formed inside the switch.

* * * * *